US007322539B2

(12) United States Patent
Huhtanen et al.

(10) Patent No.: US 7,322,539 B2
(45) Date of Patent: Jan. 29, 2008

(54) REFINING SURFACE FOR A REFINER FOR DEFIBERING MATERIAL CONTAINING LIGNOCELLULOSE

(75) Inventors: Juha-Pekka Huhtanen, Tampere (FI); Reijo Karvinen, Tampere (FI)

(73) Assignee: Metso Paper, Inc., Helsinki (FI)

( * ) Notice: Subject to any disclaimer, the term of this patent is extended or adjusted under 35 U.S.C. 154(b) by 32 days.

(21) Appl. No.: 10/519,635

(22) PCT Filed: Jul. 1, 2003

(86) PCT No.: PCT/FI03/00531

§ 371 (c)(1),
(2), (4) Date: Dec. 28, 2004

(87) PCT Pub. No.: WO2004/004909

PCT Pub. Date: Jan. 15, 2004

(65) Prior Publication Data

US 2005/0247808 A1 Nov. 10, 2005

(30) Foreign Application Priority Data

Jul. 2, 2002 (FI) ..... 20021310

(51) Int. Cl.
*B02C 7/04* (2006.01)

(52) U.S. Cl. ..... 241/261.3; 241/296

(58) Field of Classification Search ..... 241/261.2, 241/261.3, 296–298

See application file for complete search history.

(56) References Cited

U.S. PATENT DOCUMENTS 4,678,127 A * 7/1987 Cumpston ..... 241/46.04
4,712,745 A 12/1987 Leith
4,951,888 A * 8/1990 Sharpe et al. ..... 241/296
5,039,022 A * 8/1991 Nilsson ..... 241/261.1
5,373,995 A 12/1994 Johannson
5,467,931 A * 11/1995 Dodd ..... 241/261.2
6,592,062 B1 * 7/2003 Virving ..... 241/261.3
6,616,078 B1 * 9/2003 Gingras ..... 241/261.2
2002/0070303 A1 * 6/2002 Johansson et al. ..... 241/261.3

(Continued)

FOREIGN PATENT DOCUMENTS

CA 2 269 980 11/1999

(Continued)

OTHER PUBLICATIONS

Form PCT/IPEA/409 International Preliminary Report on Patentability for International Appl. No. PCT/FI2003/000531 completed Jun. 1, 2004.

(Continued)

*Primary Examiner*—Faye Francis
(74) *Attorney, Agent, or Firm*—Alston & Bird LLP

(57) ABSTRACT

The invention relates to a refining surface in a refiner for defibering material containing lignocellulose, which refiner has two coaxially rotating refining surfaces. The material being defibered is fed between the refining surfaces that both have grooves and bars. According to the invention, at least some of the refining surfaces have on their outer surface a bevel that becomes lower starting from the incoming direction of the bars of the other refining surface so that when the refining surfaces rotate relative to each other, a force that pushes the refining surfaces away from each other is created between them.

10 Claims, 4 Drawing Sheets

U.S. PATENT DOCUMENTS

| | | | | |
|---|---|---|---|---|
| 2003/0183712 | A1* | 10/2003 | Virving | 241/296 |
| 2004/0118959 | A1* | 6/2004 | Virving | 241/261.3 |

FOREIGN PATENT DOCUMENTS

| | | |
|---|---|---|
| EP | 0 172 830 | 9/1987 |
| EP | 0 702 597 | 10/1998 |
| EP | 0 776 248 | 12/1999 |
| WO | WO 96/05911 | 2/1996 |
| WO | WO 97/23291 | 7/1997 |
| WO | WO 99/54046 | 10/1999 |
| WO | WO 00/56459 | 9/2000 |

OTHER PUBLICATIONS

International Search Report for International Appl. No. PCT/FI2003/000531 completed Sep. 18, 2003.

Official Action issued in Finnish Priority Appl. No. 20021310 dated Feb. 3, 2003.

* cited by examiner

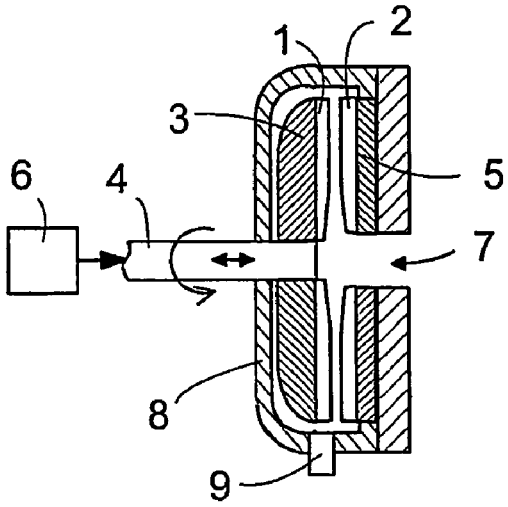
FIG.1
FIG. 2
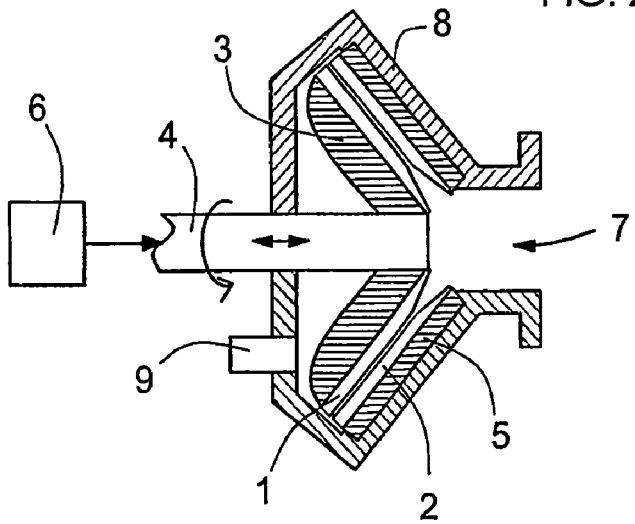
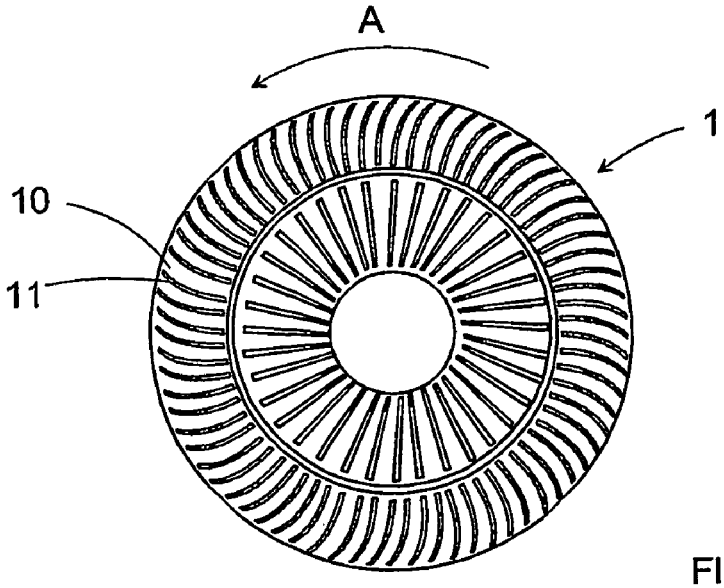
FIG. 3

REFINING SURFACE FOR A REFINER FOR DEFIBERING MATERIAL CONTAINING LIGNOCELLULOSE

FIELD OF THE INVENTION

The invention relates to a refining surface in a refiner for defibering material containing lignocellulose, which refiner has two coaxially rotating refining surfaces, between which the material being defibered is fed and which both have grooves and bars in them.

BACKGROUND OF THE INVENTION

Material containing lignocellulose, such as wood or the like, is defibered in disc and conical refiners to produce different fibre pulps. Both the disc refiners and the conical refiners have two refiner discs with a refining surface on both of them. The disc refiners have a disc-like refiner disc and the conical refiners have a conical refiner disc. The refiner discs are mounted with their coaxially rotating refining surfaces against each other. Either one of the refiner discs then rotates relative to a fixed refiner disc, i.e. stator, or both discs rotate in opposite directions relative to each other. The refining surfaces of refiner discs typically have grooves and protrusions, or blade bars, between them, called bars in the following. The shape of these grooves and bars may vary in many different ways per se. Thus, the refining surface, for instance, may in the radial direction of the refiner disc be divided into two or more circular parts, with grooves and bars of different shapes in each of them. Similarly, the number and density of bars and grooves on each circle, and their shape and inclination may differ from each other. Thus, the bars may either be continuous along the entire radius of the refining surface or there may be several consecutive bars in the radial direction.

The refiner discs are formed in such a manner that the distance between the refining surfaces is longer in the centre of the refiner discs, and the gap between the refining surfaces, i.e. refining zone, narrows outwards so that processing and defibering the fibre matter in the refiner can be done as desired. Because the material to be defibered always contains a significant amount of moisture, a great deal of vapour is generated during defibering, which affects the operation and behaviour of a disc refiner in many ways.

For controlling the operation of the refiner, it is necessary to be able to move the refining surfaces to a suitable distance from each other. For this purpose, a loader is typically connected to act on one refiner disc so as to push the refiner disc towards the second refiner disc or to pull it away from it depending on the internal pressure conditions in the refiner. The force caused by the pressure between the refining surfaces of the refiner can in a normal refiner be negative or positive depending on for instance vapour pressure, flows of the refining material affected by the geometry of the refining surfaces, counter-pressure of the refining chamber and many other factors. Thus, when the gap between the refining surfaces in some applications is quite small, there is a danger that the refining surfaces touch each other and cause extra wear and possibly even bigger damage. In special situations, in which a low loading force is used and the pressure situation between the discs may change from positive to negative, this risk is quite high.

BRIEF DESCRIPTION OF THE INVENTION

It is an object of the present invention to provide a refining surface for a refiner, by means of which this risk can substantially be avoided. The refining surface of the invention is characterized in that at least some of the bars of the refining surfaces have on their outer surface a bevel that becomes lower starting from the incoming direction of the bars of the second refining surface so that when the refining surfaces rotate relative to each other, a force that pushes the refining surfaces away from each other is always created between them.

The essential idea of the invention is that in at least some of the bars of one refining surface, the outer surface of the bar is bevelled in such a manner that the bevel is in the incoming direction of the bars of the second refining surface. This produces a situation, in which there is always a positive force between the refining surfaces and because of it, they cannot move towards each other without a separate supporting force.

BRIEF DESCRIPTION OF THE FIGURES

The invention will be described in greater detail in the attached drawings, in which FIG. 1 a cross-sectional schematic view of a conventional disc refiner, FIG. 2 is a cross-sectional schematic view of a conventional conical refiner, FIG. 3 is a cross-sectional schematic view of a typical refiner disc seen from the refining surface.

FIG. 1 is a cross-sectional schematic side view of a conventional disc refiner. The disc refiner has two coaxially mounted refining surfaces 1 and 2. In this embodiment, one refining surface 1 is on a rotating refiner disc 3 that is rotated by an axle 4. In this case, the other refining surface 2 is on a fixed refiner disc 5, i.e. stator. The refining surfaces 1 and 2 of the refiner discs 3 and 5 can be either formed directly to them or formed of separate refining segments in a manner known per se. Further, FIG. 1 shows a loader 6 that is connected to act on the refiner disc 3 through the axle 4 in such a manner that it can be pushed towards the refiner disc 5 to adjust the gap between them. The refiner disc 3 is rotated by the axle 4 in a manner known per se by using a motor not shown in the figure.

Figure 4A:
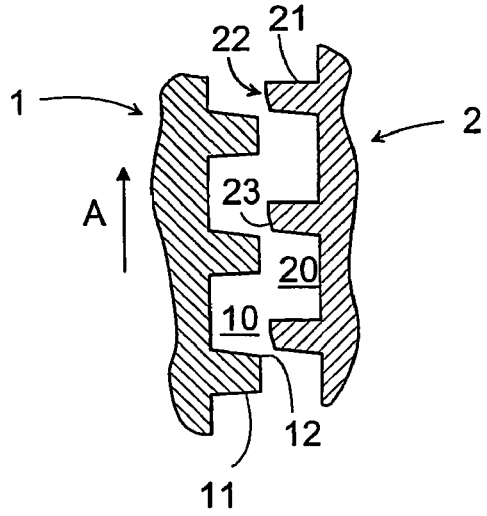
FIG. 4*a* to 4*c* are partial schematic cutaway views of a few solutions of the invention cut in the circumferential direction of the refiner discs.

The material containing lignocellulose and being defibered is fed through an opening 7 in the middle of one refining surface 2 to the gap between the refining surfaces 1 and 2, i.e. the refining zone, where it is defibered and ground while the water in the material is vaporised. The defibered fibre pulp material exits between the refiner discs from the outer edge of the gap between them, i.e. the refining zone, to a chamber 8 and exits the chamber 8 through an outlet channel 9.

FIG. 2 is a cross-sectional schematic side view of a conventional conical refiner. The conical refiner has two refining surfaces 1 and 2 that form a conical refining zone relative to the centre axis. In this embodiment, the second refining surface 1 is in a rotating refining cone 3 that is rotated by the axle 4. In this case, the other refining surface 2 is in a fixed refining cone 5, i.e. stator. The refining surfaces 1 and 2 of the refining cones 3 and 5 can be either formed directly to them or formed of separate refining segments in a manner known per se. Further, FIG. 2 shows a loader 6 that is connected to act on the refining cone 3 through the axle 4 in such a manner that it can be pushed towards the refining cone 5 to adjust the gap between them. The refining cone 3 is rotated by the axle 4 in a manner known per se by using a motor not shown in the figure.

The material containing lignocellulose and being defibered is fed through an opening 7 in the middle of one refining surface 2 to the gap between the refining surfaces 1 and 2, i.e. the refining zone, where it is defibered and ground while the water in the material is vaporised. The defibered fibre pulp material exits between the refiner cones from the outer edge of the gap between them, i.e. the refining zone, to a chamber 8 and exits the chamber 8 through an outlet channel 9.

FIG. 3 is a cross-sectional schematic view of a typical refining surface of a disc refiner seen from the direction of the axle. The refining surface has alternately grooves 10 and bars at the same position in the circumferential direction of the refiner. By way of example, the refining surface is here divided into two radially consecutive circles with grooves and bars that are different in shape. Thus, the bars in the outer circle can be at least partly curved in the rotating direction shown by arrow A in FIG. 3 so that the material on the outer rim of the refining surface is in a way pumped outwards of the refiner. Refining surfaces of this type, which are either formed directly to the refiner disc or formed of different surface elements in a manner known per se, exist in several forms and can be applied according to the invention.

Figure 4B:
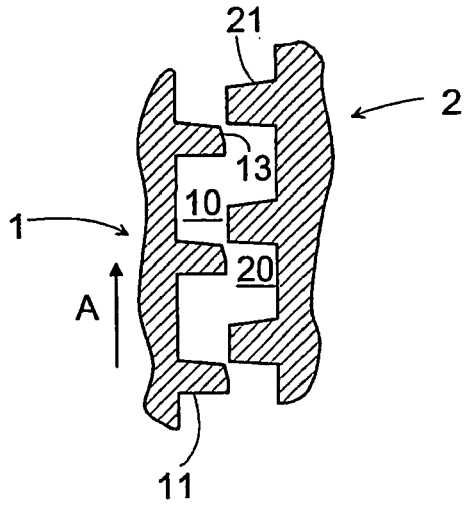
Figure 4C:
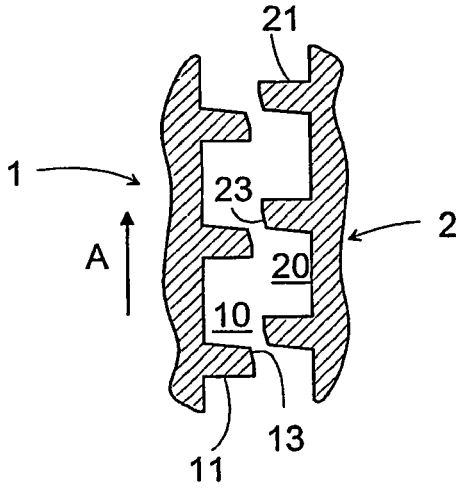

FIGS. 4*a* to 4*c* are cross-sectional schematic views in the direction of the refiner circumference showing a section of the opposing refining surfaces 1 and 2 and the grooves 10 and bars 11 in them. By way of example, the refining surface 2 on the right is fixed, i.e. the stator, and the refining surface 1 on the left rotates, i.e. moves in the direction shown by arrow A in FIGS. 4*a* to 4*c* relative to the stator. Both refining surfaces can be mobile or rotate coaxially in a manner known per se. The refining surfaces are typically vertical and rotate around a horizontal axle, but the invention can also be applied to solutions, in which the refining surfaces are horizontal.

FIG. 4*a* shows a case, in which there are grooves 10 on a rotating refining surface, and bars 11 between the grooves. The bars 11 can have various shapes in cross-profile, but in such a manner that in the direction of travel, there is a bevel 12 which to a certain extent acts as a cutter when the fibres are cut. The second refining surface has grooves 20 and bars 21 between them. The grooves 10 and 20 can have many shapes. In at least some of the bars on the second refining surface 2, the outer surface 22 has a bevel 23 that is convergent, i.e. becomes lower from the incoming direction of the bars 11 of the first refining surface towards the back end of the bar 21. Part of the outer surface 22 of the bar 21 of the second refining surface 2 can be even so that the fibre material between the bars of the refining surfaces is chafed and ground smaller between them. The movement of the refining surfaces rotating relative to each other makes the material being defibered and the vapour and gas in the disc refiners press between the outer surfaces of the bars 11 and 21 at the bevel 23, which causes an ascending force that pushes the refining surfaces away from each other. By suitably planning and designing the shape, size and location of the bevels 23 in the radial direction of the bars produces a situation, in which a force that pushes the refining surfaces 1 and 2 away from each other always acts between them. As a result of this, the refining surfaces will never touch each other, but try to draw away from each other, and the distance between them can easily and reliably be adjusted merely by adjusting the supporting force of a support apparatus that presses the refining surfaces together from the outside.

FIG. 4*b* shows an embodiment, in which the bars 11 of a moving rotor 1, i.e. a rotor rotating around an axle, have bevels 13. The operation of these corresponds per se to the operation in FIG. 4*a*.

FIG. 4*c* shows an embodiment, in which the bars 11 and 21 of both refining surfaces 1 and 2 have corresponding bevels 13 and 23. This way, the force pushing the refining surfaces away from each other can be made stronger than when the bevel is on the bars of only one refining surface.

Figure 5:
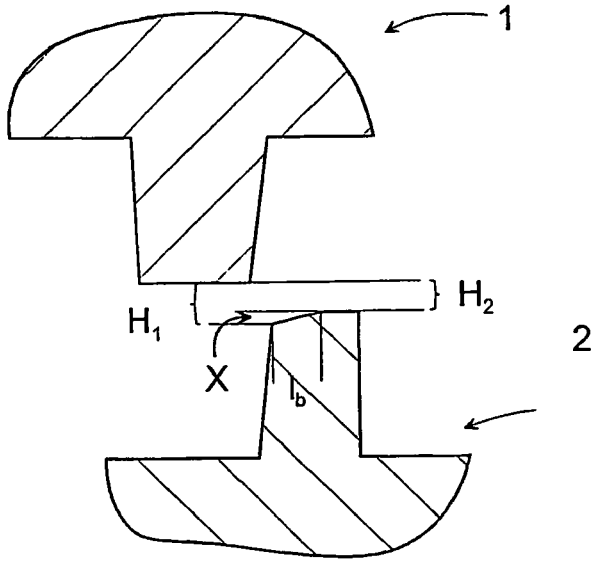
FIG. 5 is a schematic view of the detailed dimensioning of the invention.

FIG. 5 is a more detailed schematic view of the dimensioning of the invention. For the sake of simplicity, it only shows one refining surface bar on both sides. It shows the maximum distance $H_1$ and minimum distance, i.e. clearance, $H_2$ between the end surfaces of the bars of both refining surfaces.

Several factors affect the magnitude of the force pushing the refining surfaces away from each other. These include the mutual speed of the refining surfaces at the bevels of the bars, the amount of material and water vapour in the refiner, and the dimensions, inclination and shape of the bevels.

On the basis of the above, it can be established that in certain circumstances, the maximum force obtained by means of a bevel can be defined by an expression known from flow dynamics, as disclosed for instance in B. J. Hamrock, Fundamentals of Fluid Film Lubrication, McGraw-Hill Series in Mechanical Engineering, McGraw-Hill Inc., New York, 1994, as follows:

$$F_T = \frac{6 \cdot \mu_{gp} \cdot V_b \cdot l_b^2}{(k_c - 1)^2 \cdot H_2^2} \cdot \left[\ln(k_c) - \frac{2 \cdot (k_c - 1)}{k_c + 1}\right],$$

wherein $k_c = H_1/H_2$ (ratio between the input and output clearances of the end surfaces of the bars), $V_b$=speed between the refining surfaces, and $l_b$=length of bevel.

The maximum force is obtained by calculating the maximum point of the function $F_T$ relative to the variable $k_c$. The maximum force is obtained with the $k_c$ value of 2.2.

$$F_{T\,\max} = 0{,}16 \cdot \frac{\mu_{gp} \cdot V_b \cdot l_b^2}{H_2^2}.$$

Figure 6A:
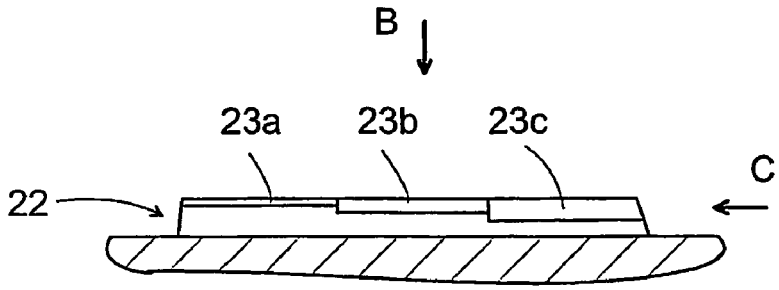
FIGS. 6*a* to 6*c* are schematic views of a preferred embodiment of the invention.
Figure 6C:
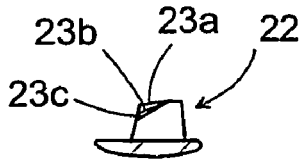
Figure 6B:
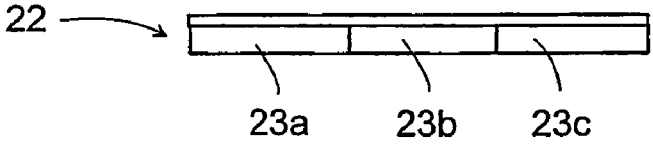

FIGS. 6*a* to 6*c* show a preferred embodiment of the invention, in which it has been possible to take into account that when the distance between the refining surfaces changes, the force acting between the refining surfaces must change correspondingly as necessary. This embodiment shows by way of example a bar 22 of one refiner disc, which can be either a radial bar along the entire refiner disc or a bar or part of a bar forming only a part of it. This embodiment employs a solution, in which the bar has three bevels that are different in inclination, and the operation of each of the bevels is at its most advantageous at a specific distance between the refining surfaces. This way, when the distance between the refining surfaces changes, it is possible to utilize the bevel surface that best operates at the distance in question to achieve the necessary push force. FIG. 6*a* shows the embodiment as seen from the surface of the refiner disc, FIG. 6*b* shows the top surface of the bar 22 as seen from the direction of arrow B, and FIG. 6*c* shows the bar 22 as seen from the direction of arrow C, i.e. from the end of the bar. These show how the bevels are made different at different points along the bar 22. There may be one or more bevels. In this solution, there are three bevels.

Figure 7A:
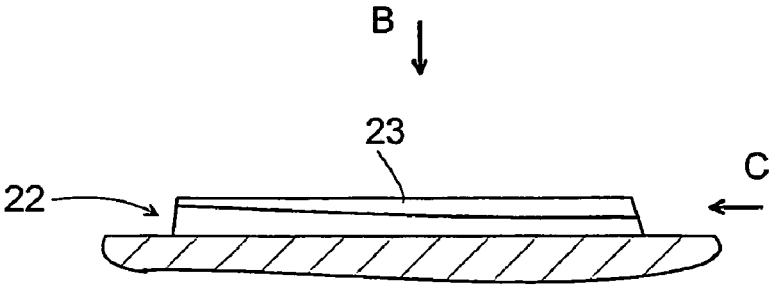
FIGS. 7*a* to 7*c* are schematic views of a second preferred embodiment of the invention.
Figure 7C:
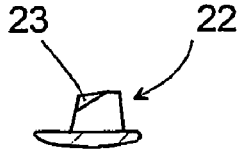
Figure 7B:
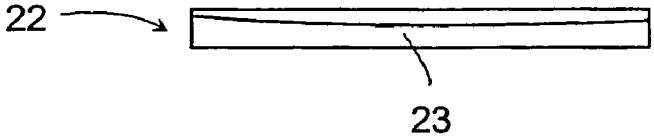

FIGS. 7*a* to 7*c* show a second preferred embodiment of the invention. This embodiment shows a similar solution as in FIGS. 6*a* to 6*c* from the corresponding directions. However, this embodiment differs from the alternatives shown above in that it is not a combination of consecutive bevels with the same inclination, but the inclination of the bevel changes from one end of the bar 22 to the other most preferably continuously so that the size of the inclination of the bevel 23 changes from one end of the bar 22 to the other. For manufacturing, it is of course advantageous to have the highest inclination at one end and the lowest at the other end. Similarly, FIG. 7*b* in particular shows that the width of the bevel in the transverse direction of the bar 22 is not necessarily constant, but may vary and can be designed in different ways depending on the operating conditions.

Figure 8A:
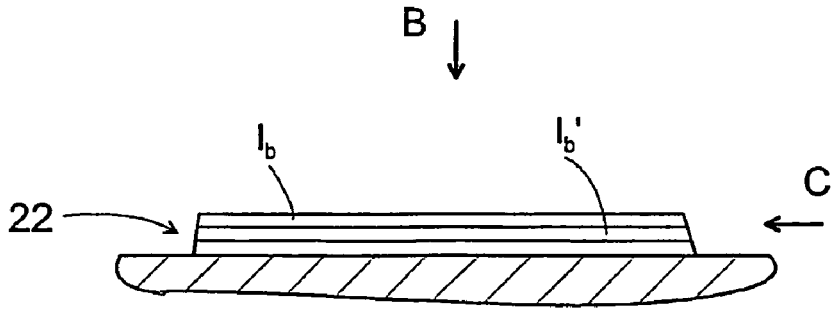
FIGS. 8*a* to 8*c* are schematic views of a third preferred embodiment of the invention.
Figure 8B:
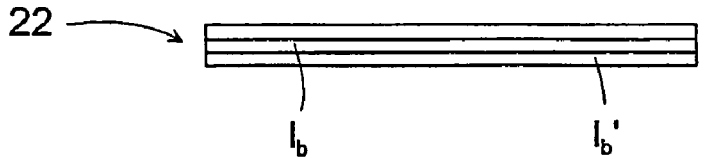
Figure 8C:
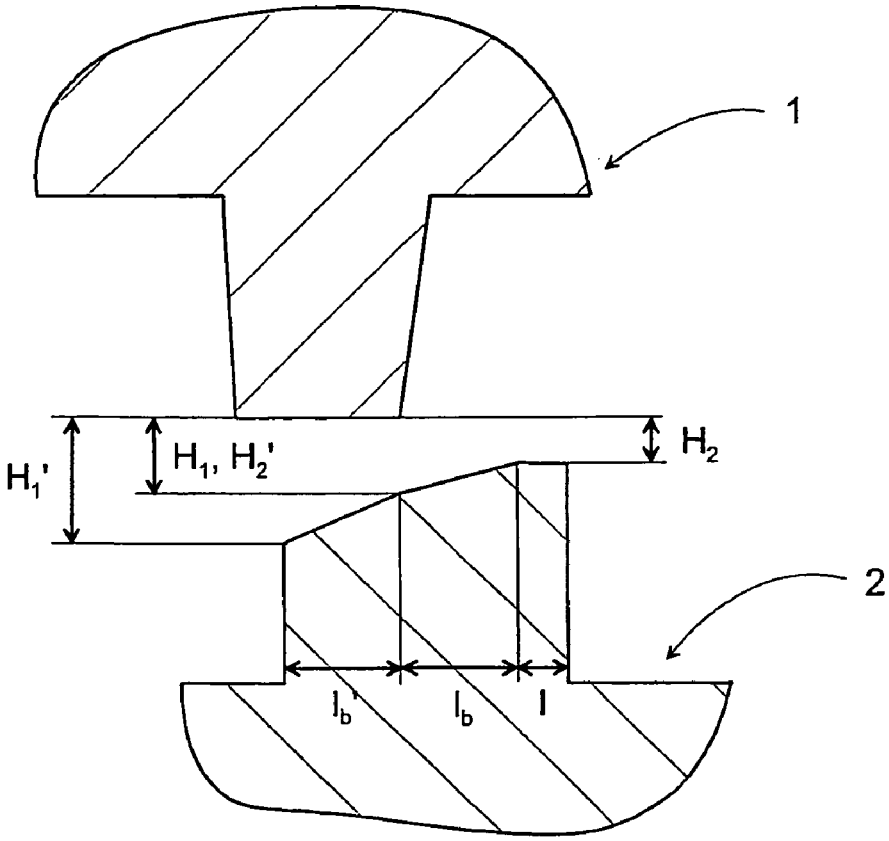

FIGS. 8*a* to 8*c* show a third preferred embodiment of the invention. This embodiment shows a similar solution as in FIGS. 6*a* to 6*c* from the corresponding directions. However, this embodiment differs from the alternatives shown above in that it is not a combination of consecutive bevels with the same inclination, but the bar 22 has at least two parallel bevels Ib and Ib' in the longitudinal direction of the bar 22 and the bevels are at different angles as seen from the direction of arrow C of the bar 22, i.e. from the end of the bar 22.

The solution shown in FIG. 8*c* can be formed in such a manner, for instance, that the entire width I+Ib+Ib' of the bar 22 is 6.5 mm, in which the width of the bevel Ib is 3 mm and the width of the bevel Ib' is 3 mm. When the clearance of the blade surfaces, i.e. the output clearance $H_2$, is 0.1 mm by way of example, a preferable input clearance $H_1$ according to the invention is 0.22 mm, which is at the same time the output clearance $H_2'$ of a second bevel, which then produces 0.484 mm as the value of the most preferable input clearance $H_1'$. The input and output clearances are calculated using the expression of the input and output clearance ratio described above. The formulas $H_1=k_c \times H_2$ and $H_1'=k_c \times H_2'$ as applied to this solution have been used in the calculation. The clearance values are calculated with the input and output clearance ratio $K_c$ value 2.2 that produces the highest possible force $F_{Tmax}$ that pushes the refining surfaces away from each other. By calculating for both partial bevels a force that pushes the refining surfaces away from each other and summing the forces produces the force opening the refining surfaces of this solution. In this example, the distance $H_2$ between the opposite refining blades is 0.1 mm. The blades can be optimized to a desired blade distance by changing this value, whereby the value of the bevel also changes according to the formula.

The width and length of the bevel in the bars can be designed in different ways when the number and location of the bars in the radial direction of the refining surface and the rotating speed are known, on the basis of which it is possible to calculate the magnitude of the force achieved by the bevels and pushing the refining surfaces away from each other. Thus, the bevel can be as wide as the entire bar or narrower. Similarly, the bevel can be as long as the bar or shorter. There may also be bevels in only some of the bars, for instance in every second bar, etc. The bevel can be even or convex or concave in the transverse direction of the bar. Similarly, the bevel can vary in width in the longitudinal direction of the bar, for instance it can narrow from the centre outwards, etc. Even though for achieving the maximum force, the value for parameter $k_c$ is 2.2, it is possible to deviate from this value, and a useful range found in practice is $k_c$=2.2+/−50%, preferably $k_c$=2.2+/−20%. Bevels with different inclinations can also be formed either consecutively in the radial direction on different bevels or alternately in the circumferential direction of the refining surface.

The invention is in the above description and the drawings described by way of example and it is not in any way limited thereto. The essential thing is that at least in some of the bars of the refining surface, there is a bevel convergently inclined from one edge of the bar to the other on the edge of the bar from which the bars of the other refining surface come when the refining surfaces move. The refining surfaces are typically vertical and rotate around the centre axis, but it is also possible to apply the invention to solutions, in which the refining surfaces are horizontal. The invention can be applied to twin gap refiners with a floating rotor, known to persons skilled in the art. A general problem with twin gap refiners is that the blade clearance does not remain the same in both refining zones, if there is even a small flow change in one refining zone. The solution of the invention stabilizes the operation of the motor and prevents one-side collision of the blades. Further, the invention can be applied to low-consistency refining and refining the fibres of fibreboard.

The invention claimed is:

1. A refining surface of a refiner, the refiner having two opposed refining surfaces coaxially-disposed along an axis, with at least one of the refining surfaces being configured to rotate about the axis in a rotation direction, and the refining surfaces being configured to receive a lignocellulose material therebetween for defibering thereof, the refining surface comprising:

a plurality of radially-extending bars defining grooves between adjacent bars, each groove having a bottom surface, and each bar having a leading surface and an opposed trailing surface with each of the leading and trailing surfaces being configured to extend away from the bottom surface of the respective grooves, each bar also having a radially-extending length and an angularly-extending width, at least one of the bars including a non-concave bevel extending from a leading edge of the leading surface of the bar, the leading edge of the leading surface being defined with respect to the interaction of the non-concave bevel with the opposed refining surface, the non-concave bevel being spaced apart from the bottom surface of the groove along the leading surface and extending across the bar, from the leading surface, for less than the entire width thereof, the remainder of the width of the bar extending from the non-concave bevel to the trailing surface being substantially parallel to the refining surface, the leading edge of the non-concave bevel being further configured such that, as an opposed bar of the opposed refining surface approaches axial coincidence with the non-concave bevel, an increasing force is generated substantially perpendicularly to the refining surface and axially outward with respect to the opposed refining surfaces.

2. A refining surface according to claim 1, wherein less than all of the plurality of bars includes the non-concave bevel.

3. A refining surface according to claim 1 wherein the non-concave bevel is configured so as to define a ratio between a maximum clearance ($H_1$) and a minimum clearance ($H_2$) between bars of the opposed refining surfaces, $H_1/H_2=2.2\pm50\%$.

4. A refining surface according to claim 1, wherein the ratio is $H_1/H_2=2.2\pm20\%$.

5. A refining surface according to claim 3, wherein the ratio is $H_1/H_2=2.2$.

6. A refining surface according to claim 1, wherein the non-concave bevel extends for less than the entire length of the bar.

7. A refining surface according to claim 1, wherein at least one of the bars includes a plurality of non-concave bevels, with the non-concave bevels extending for less than the entire width of the bar, and each non-concave bevel having a different slope with respect to the bar.

8. A refining surface according to claim 7, wherein the non-concave bevels are serially disposed across the bar, for less than the entire width thereof, such that the slope decreases with each non-concave bevel, each non-concave bevel being successively disposed axially inward with respect to the opposed refining surfaces.

9. A refining surface according to claim 7, wherein the bars spaced apart in an angular direction about the refining surface alternatingly include non-concave bevels having different slopes.

10. A refining surface according to claim 1, wherein at least one of the non-concave bevels defines a slope with respect to the bar, the slope being configured to vary along the length of the bar.

* * * * *

UNITED STATES PATENT AND TRADEMARK OFFICE

CERTIFICATE OF CORRECTION

PATENT NO. : 7,322,539 B2
APPLICATION NO. : 10/519635
DATED : January 29, 2008
INVENTOR(S) : Huhtanen et al.

It is certified that error appears in the above-identified patent and that said Letters Patent is hereby corrected as shown below:

Column 7,
Line 9: "according to claim 1" should read --according to claim 3--

Signed and Sealed this

Twenty-seventh Day of May, 2008

JON W. DUDAS
*Director of the United States Patent and Trademark Office*